United States Patent [19]

Jujasz et al.

[11] Patent Number: 4,732,597

[45] Date of Patent: Mar. 22, 1988

[54] LOW ENERGY CONSUMPTION METHOD FOR SEPARATING GASEOUS MIXTURES AND IN PARTICULAR FOR MEDIUM PURITY OXYGEN PRODUCTION

[75] Inventors: Albert J. Jujasz, North Olmsted; James A. Burkhart, Olmsted Falls, both of Ohio; Ralph Greenberg, New York, N.Y.

[73] Assignee: The United States of America as represented by the United States Department of Energy, Washington, D.C.

[21] Appl. No.: 854,600

[22] Filed: Apr. 22, 1986

[51] Int. Cl.[4] ..... F25J 3/02

[52] U.S. Cl. ..... 62/24; 62/41; 62/44

[58] Field of Search ..... 62/9, 11, 32, 24, 36, 62/41, 42, 44

[56] References Cited

U.S. PATENT DOCUMENTS

| | | | |
|---|---|---|---|
| 3,260,059 | 7/1966 | Rosenberg et al. | 62/24 |
| 4,272,270 | 6/1981 | Higgins | 62/24 |
| 4,453,956 | 6/1984 | Fabbri | 62/44 |

*Primary Examiner*—Ronald C. Capossela

*Attorney, Agent, or Firm*—William W. Randolph; Judson R. Hightower; Richard E. Constant

[57] ABSTRACT

A method for the separation of gaseous mixtures such as air and for producing medium purity oxygen, comprising compressing the gaseous mixture in a first compressor to about 3.9–4.1 atmospheres pressure, passing said compressed gaseous mixture in heat exchange relationship with sub-ambient temperature gaseous nitrogen, dividing the cooled, pressurized gaseous mixture into first and second streams, introducing the first stream into the high pressure chamber of a double rectification column, separating the gaseous mixture in the rectification column into a liquid oxygen-enriched stream and a gaseous nitrogen stream and supplying the gaseous nitrogen stream for cooling the compressed gaseous mixture, removing the liquid oxygen-enriched stream from the low pressure chamber of the rectification column and pumping the liquid, oxygen-enriched steam to a predetermined pressure, cooling the second stream, condensing the cooled second stream and evaporating the oxygen-enriched stream in an evaporator-condenser, delivering the condensed second stream to the high pressure chamber of the rectification column, and heating the oxygen-enriched stream and blending the oxygen-enriched stream with a compressed blend-air stream to the desired oxygen concentration.

9 Claims, 1 Drawing Figure

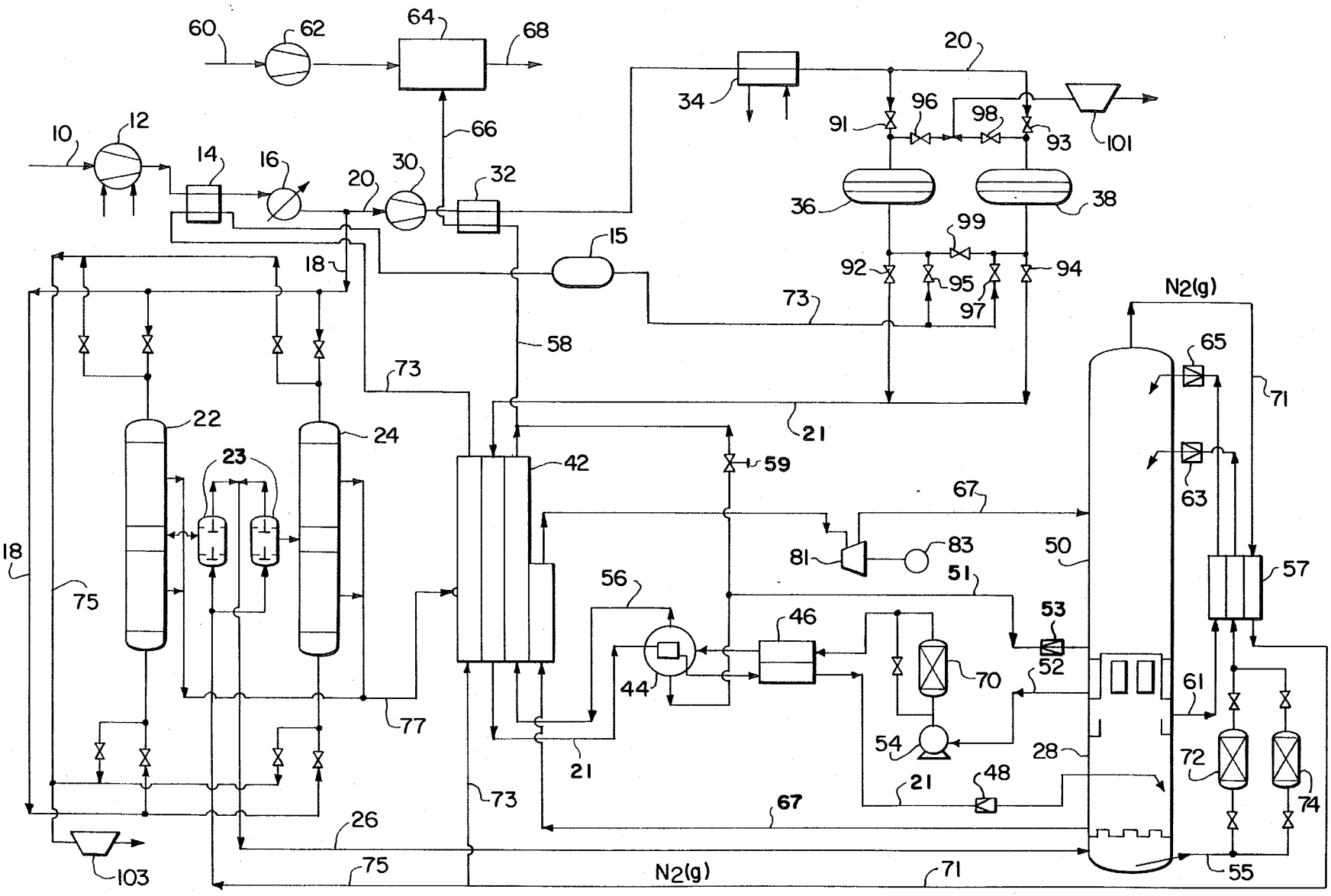
N2(g)
N2(g)

LOW ENERGY CONSUMPTION METHOD FOR SEPARATING GASEOUS MIXTURES AND IN PARTICULAR FOR MEDIUM PURITY OXYGEN PRODUCTION

This invention relates to a method for the separation of gaseous mixtures into their component gases. More particularly, the invention relates to a process for separating gaseous mixtures of a higher boiling component and a lower boiling component. The invention particularly relates to a process for the production of a medium purity oxygen product from air. The invention also relates to a process requiring greatly reduced power consumption for producing oxygen of medium purity from air by separation of the gases in the air.

BACKGROUND AND OBJECTS OF THE INVENTION

Many types of air separation plants are known from the prior art for separating air into its various components, chiefly oxygen and nitrogen. The processes used heretofore in such plants have been highly energy intensive, making the cost of the separated gases equally expensive. One reason for the high cost has been the fact that usually only high purity oxygen or nitrogen is produced, whether the high purity was needed or not. In circumstances where high purity was not needed, often the highly pure oxygen was simply diluted with air to the required purity or oxygen content.

Cryogenic air separation processes utilize the difference in boiling points of the various air components, principally oxygen and nitrogen, and the changes in boiling points with pressure to achieve component separation by fractional distillation. The basic process utilizes a number of auxiliary components such as compressors, expanders, heat exchangers, adsorbers, switching valves, and the like, whose function is to change the state of the input air stream so that component separation can take place and to condition the output streams to user requirements.

The actual separation (or rectification) process is usually carried out in "double rectification columns" which have an upper compartment operated at low pressure (near atmospheric in most cases) and a lower compartment operated at higher pressure. The lower compartment is usually referred to as the medium pressure column and the upper compartment, as the low pressure column. Both columns are provided with a number of perforated separation trays which in use bring about a series of fractional evaporations and condensations between a rising vapor which is successively enriched in nitrogen and a falling liquid which is being enriched in oxygen.

The process requirements for this heat and mass transfer to occur in the two phase, two component, countercurrent flow environment requires pressure differences between the two columns and thereby dictates the process energy input required for the air separation unit (ASU) air compressor. This is so since nitrogen, which at atmospheric pressure has a lower boiling point than the desired product oxygen, must condense at the top of the medium pressure column in order to evaporate product oxygen at the bottom of the low pressure column. The only way in which this condition may be met is for the condensation of nitrogen to take place at a higher pressure than that of the evaporating product oxygen.

It should be noted that the higher the desired oxygen concentration or purity of the product collecting at the bottom of the low pressure column, the greater the pressure difference requirement between the two columns and the higher the compressor power input for the same input air flow.

In many plants, the removal of water and carbon dioxide is combined with the cooling of the air, and this is done in reversing heat exchangers or regenerators.

In a typical prior art separation process, filtered atmospheric air is compressed in an intercooled and aftercooled air compressor to a pressure which is determined by the requirements of the particular process, usually about 4 to 6 atmospheres. It is then passed through a water separator and adsorber to heat exchangers and cooled to about 100° K. (−280° F.) with the aid of an expansion turbine.

The cold air is then injected as a saturated vapor into the medium pressure column where it is separated into a nitrogen fraction and a so-called rich liquid fraction containing about 40% oxygen. The separation is obtained by contacting the rising vapor with liquid nitrogen flowing down from the condensor-evaporator. This causes the liquid collecting at the bottom of the column to become enriched in oxygen while the vapor which is condensed at the top of the column to become enriched in nitrogen. Both fractions leave the lower column in the liquid state and flow through expansion valves to the low-pressure column where additional rectification to the final product purity takes place. Both nitrogen and oxygen leave the low pressure column in the gaseous state at near atmospheric pressure and are regeneratively heated by the process input air stream before being delivered to the user.

Traditionally, air separation plants have been designed to deliver high purity products (95 to 99.9 mol percent oxygen), even if the final application required a much lower oxygen purity. For example, in applications such as MHD plants or blast furnaces requiring only up to 40 percent oxygen concentration, but at elevated pressures, the product stream is mixed with atmospheric air before compression in specially designed uncooled oxygen-enriched air compressors. Alternatively, the product oxygen and the dilution air may be compressed to final user pressure in separate oxygen compressors and air compressors before being mixed to the desired oxygen concentration.

High purity air separation processes such as just described are not considered to be energy efficient. For example, such processes would require a specific energy consumption (SEC) in the range of 280 to over 300 kWh/(ton of equivalent pure oxygen), or 280 to 300 kWh/TEPO.

More recently, an advanced medium purity process has been developed in Europe which also requires external compression of the product stream, but which has reduced the energy consumption to approximately 224 kWh/TEPO by delivering a product containing only 60 mol percent oxygen. While this represents a significantly more energy efficient process, and is less hazardous than external compression of a high purity oxygen stream, the process still requires special turbomachinery having lower efficiencies than an equivalent air compressor because of the greater blade clearance and buffer gas bleed flow requirement. These safety precautions are required because the medium being compressed, although not as hazardous as pure oxygen, does have a higher oxygen content than normal air, and accordingly any ingested foreign particles such as dust, lubricating oil droplets, or abraded blade material can ignite more easily than in air.

Accordingly, a primary object of the present invention is to provide a safe, energy efficient process for separating gaseous mixtures.

A further object of the present invention is to provide a process for the separation of gaseous mixtures which is particularly useful for separating the component gases in air.

Still another object of the invention is to provide an energy efficient process for separating mixtures of gases of differing boiling points.

Another object of the invention is to provide a process for producing medium purity oxygen from air.

A further object of the invention is to provide an improved process for producing medium purity oxygen with low power consumption.

Still another object of the invention is to provide an improved, energy efficient process for producing medium purity oxygen at the concentration and pressure required by the user.

Yet a further object of the invention is to provide an energy efficient process capable of separating gaseous mixtures for producing a high purity gaseous product, such as oxygen, at significantly lower energy consumption than possible with prior art processes.

DESCRIPTION OF THE DRAWING

These and other objects and advantages of this invention will become apparent in light of the following description and claims, when taken together with the accompanying drawing which is a schematic representation of a separation plant based upon the improved process of this invention.

DESCRIPTION OF THE INVENTION

The description of the invention will proceed on the basis of separating air into its oxygen and nitrogen components. However, it will be understood by one of skill in the art that the invention applies equally to separating other mixtures of gases of differing boiling points in which the higher boiling component would correspond to oxygen and the lower boiling component would correspond to nitrogen.

According to the process of the present invention, input air is compressed to the required pressure ratio in a conventional intercooled-aftercooled compressor. The exact pressure ratio is determined according to the desired product pressure and oxygen concentration, but is ordinarily in the range of 3.9 to 4.1 atmospheres, or about 57–61 psia.

Most of the heat which would normally be rejected by the aftercooler to cooling water is transferred to "waste nitrogen" which, after additional heating to about 120° C. (250° F.) by low pressure steam, is used to regenerate molecular sieve adsorbers used in another part of the process.

Downstream of the aftercooler the air circuit is split into two branches. The first branch carries lower column input air which is purified and cooled to near its boiling point, 94° K. (−291° F.), in the main air regenerators before it is injected into the lower column. The second air branch carries the vaporizer stream, the purpose of which is to evaporate a pressurized liquid product. This vaporizer stream is further compressed in a boost air compressor with the heat of compression being saved for product heating in the heat exchanger. The amount of compression in the boost air compressor is again a function of the desired final pressure and composition of the product according to the enthalpy balances of the system.

The vaporizer stream is chilled to below 10° C. (50° F.) and purified in molecular sieve adsorbers which remove remaining traces of water vapor, carbon dioxide, and dangerous traces of hydrocarbons. These molecular sieve adsorbers utilize the physical property of some natural or synthetic materials such as silica, alumina, or the like, having a microcrystalline structure to retain or adsorb certain constituents from the process air stream and store them in the internal pores. When the concentration of these stored impurities in the adsorber pores reaches a predetermined maximum value, the process stream is switched to a fresh adsorber unit. Meanwhile, a warm nitrogen purge stream is sent through the saturated adsorber unit to effect regeneration, i.e. to remove the stored impurities. To ensure continuous operation, at least two such adsorbers are used, with one being in the adsorbing mode while the other is in the regenerating or "desorbing" mode.

The thus purified stream is then cooled in a heat exchanger before entering the product evaporator where it is condensed against evaporating product oxygen. The required flow rate and pressure level of the vaporizer stream are determined by the user specified flow rate and pressure level of the product stream.

The condensed vaporizer stream is subcooled and expanded through a Joule-Thompson valve into the medium pressure column (lower column). The double air separation column is the same as used in conventional processes. However, the medium purity product which accumulates at the bottom of the low pressure column (upper column) is removed as a liquid and pumped to the desired pressure, vaporized in the evaporator by the condensing vaporizer stream, heated to ambient temperature in a heat exchanger, and further heated in a product-to-boost air heat exchanger. The pressurized product is then blended with a separately compressed "blend air" stream to the desired oxygen concentration. The resulting oxygen enriched air (oxidant) stream is then ducted to the user.

The process thus utilizes the important steps of pressurizing the product stream by pumping the product in the liquid state to the final end use pressure prior to evaporation, product vaporization at this pressure, followed by heating and mixing with a separately compressed air stream to obtain the desired oxygen concentration. The pumping of the liquid stream requires less than about 2% of the power required by compression in the gaseous state.

Thus the process according to the present invention, in which the product from the upper column is pumped as a liquid to the desired pressure, evaporated and heated, and then mixed with air compressed in the blend air compressor has a lower overall energy consumption than in the optimized conventional process in which an atmospheric pressure product is mixed with ambient air and the resulting oxidant stream is compressed in the oxidant compressor. It will also be appreciated that an oxidant compressor (an axial/radial machine) must be rated for oxygen enriched air service which implies a small penalty on efficiency and cost, whereas the blend air compressor used in the new process only must compress air, which is less hazardous, and therefore can be compressed more efficiently in a multi-stage axial compressor.

The process delivers a medium purity oxygen (60–80% $O_2$) product) and a pure nitrogen by-product, and therefor a lower mass flow of input air needs to be compressed, and even then only to about 4 atmospheres. Further, the process uses the heat rejected by the process compressors to raise the temperature of the product oxygen. Thus the lower input air pressure requirements coupled with an improved internal heat management scheme contribute to the significantly improved energy efficiency of the process of this invention.

The specific energy consumption (SEC) for the present process is on the order of 175 kWh/TEPO for a product oxygen concentration on the order of 70–80% oxygen based upon an initial air compression to only about 56 psia. Since the product is extracted in the liquid state, pumped to user pressure and then vaporized, the process eliminates the hazardous operation of compressing gaseous oxygen. Tests have shown that maximum energy efficiency occurs at about 70–80% product purity and that at 40% purity, the SEC is about 255 kWh/TEPO and at higher purity the SEC also increases to about 240 kWh/TEPO.

Not only does this process deliver the product at a user specified pressure, but it can also preheat the product stream to over 200° C. (400° F.). This represents a significant advantage in applications such as blast furnace enrichment and oxygen blown steel conversion, as well as advanced coal gasification processes which require preheated oxidant streams.

DESCRIPTION OF THE PREFERRED EMBODIMENTS

Turning now to the simplified process diagram as shown in the drawing, the input air is introduced through line 10 where it is compressed to the required pressure ratio, in a conventional intercooled-aftercooled compressor 12 as is done in conventional medium purity air separation processes, but here the compressor discharge pressure is only on the order of about 3.9–4.1 atmospheres (about 57–61 psia). The compressed air then passes through a heat exchanger 14 and through an aftercooler 16 whereby the heat is transferred to "waste" or by-product nitrogen which can be further heated in the regenerating steam heater 15 if desired.

The stream then splits into two branches 18 and 20. Branch 18 carries lower column input air which is purified and cooled to near its boiling point in the main air regenerative heat exchangers 22 and 24, the tandem operating mode of which is controlled automatically by programmed switching valves 23, before it is discharged and injected through line 26 to the lower column 28.

Branch 20 carries the vaporizer stream for evaporating a pressurized liquid product. This vaporizer stream is further compressed in a boost air compressor 30 with the heat of compression being used for product heating in the heat exchanger 32. The vaporizer stream is chilled to below 10° C. (50° F.) in the chiller 34 using cooling tower water and purified in molecular sieve adsorbers 36 and 38 which remove remaining traces of water vapor, $CO_2$ and hydrocarbons. The stream then passes through line 21 into heat exchanger 42 and into the product evaporator 44 where it is condensed against evaporating product oxygen. Non-condensed air from evaporator 44 is circulated via line 51 and J-T valve 53 to column 50 and is also used for flow and pressure regulation via regulating valve 59. It should be noted that the required flow rate and pressure level of the vaporizer stream are determined by the user specified flow rate and pressure level of the product stream.

The condensed vaporizer stream is next subcooled in the subcooler 46 and is then expanded through a Joule-Thompson valve 48 into the medium pressure (lower) column 28.

As is understood by those skilled in the art, the purity of product obtained in the lower column 28 is only about 40 mol percent oxygen. Hence, to achieve the desired final product oxygen purity, the low purity product accumulating at the bottom of the column 28 is sent through line 55 and adsorbers 72 and 74 through sub-cooler 57 and expanded via Joule-Thompson valve 63 into the low pressure column 50, where the required additional separation takes place. Also needed for the separation process taking place in column 50 is liquid nitrogen which is collected at the top of column 28 and sent through line 61 and sub-cooler 57 before being expanded through Joule-Thompson valve 65 into column 50.

Finally, gaseous product oxygen is withdrawn from column 28 through line 67 and sent via heat exchanger 42 prior to being expanded through expansion turbine 81 into column 50. The energy extracted from the gas in line 67 by turbine 81 can be used to drive a power consuming device, such as a pump, compressor of small electric power generator shown at 83.

The cold by-product nitrogen gas stream, exiting at slightly above atmospheric pressure from the top of column 50 via line 71, is used to cool previously mentioned streams 55 and 61 in subcooler 57. Part of this nitrogen gas stream is sent through line 73 into heat exchanger 42 where, together with streams 56 (product stream) and 67 (re-cycle stream), it is used to cool the vaporizer stream 21. Next, stream 73 is used to help cool the compressed air stream delivered by compressor 12 to heat exchanger 14. Subsequently stream 73 is heated in steam heater 15 before being available for regenerating adsorbers 36 and 38. As discussed above, these two adsorbers operate in tandem, and the cyclic operating mode is automatically controlled by pre-programmed switching valves 91–99. Gaseous nitrogen stream 73, now carrying the impurities purged from the adsorbers, is finally exhausted through silencer 101 to the atmosphere.

Most of the by-product nitrogen stream is transported in line 75 through the switching valves 23 to the main air regenerative heat exchangers 22 or 24, in order to absorb heat and impurities (mainly water vapor and carbon dioxide) therefrom. The main regenerative heat exchangers (or air regenerators) 22 and 24 also operate in a tandem mode, with one unit cooling the input air stream 18 while the other is being cooled and purged by nitrogen gas stream 75, and vice versa.

To balance the cooling nitrogen flows between the main air regenerators 22 and 24, and heat exchanger 42, some of the cooling nitrogen is tapped from the midpoint of the air regenerators and delivered via line 77 to the matching temperature location of heat exchanger 42 where the cooling nitrogen mixes with the cooling nitrogen in line 73 of heat exchanger 42. The warm nitrogen stream in line 75, now containing some of the impurities originally present in the input air stream 18 (mostly carbon dioxide and water) is finally discharged to atmosphere through silencer 103.

Of course this nitrogen stream can also be collected and, after a degree of purification, become a separate nitrogen product. Alternatively, in certain applications where the moisture content of the "impure" nitrogen is low enough, this stream could be heated and used as a drying medium. Typical examples of such applications would be in coal drying in the steel industry and in coal burning power plants. Of course nitrogen stream 73 could also be similarly used instead of being vented to the atmosphere.

The medium purity product which accumulates at the bottom of the low pressure (upper) column 50 at essentially atmospheric pressure is removed as a liquid through line 52 and pumped by the pump 54 to the desired pressure. The liquid passes through the subcooler 46 and is then vaporized in the evaporator 44 by the condensing vaporizer stream. The product then passes through line 56 and into the heat exchanger 42 where it is heated to ambient temperature, then passing through line 58 into the product to boost air heat exchanger 32 where it is further heated.

A separate blend air intake 60 supplies air to a compressor 62 which in turn supplies the compressed blend air to a mixing duct 64 where the product arriving from the heat exchanger 32 through line 66 is blended with the additional air, and the final product is delivered through output line 68 to the user.

For applications in which the product stream is desired in gaseous form at atmospheric pressure, the boost air compressor system as well as the molecular sieve adsorbers 36 and 38, and the regeneration heater 14 may be eliminated. In this case, product evaporation would be accomplished by recycling pressurized gaseous mixture from the lower column 28 to the heat supply side of product evaporator 44. This recycled gas will condense in the evaporator 44, giving up its latent heat to the atmospheric pressure liquid product stream which is thereby caused to vaporize. Further heating of the vaporized product stream to ambient conditions is accomplished in the heat exchanger 42.

If desired, a further argon separating column may be added in order to remove argon from the product oxygen stream and although this is not ordinarily required for medium purity applications, it can be advantageous where high purity oxygen product is required or where argon is to be used as a by-product.

Also seen optionally in the drawing are molecular sieve adsorbers 70, 72 and 74 which serve to remove impurities from the various streams in a conventional manner.

The following table gives comparative process parameters and power consumption for the advanced medium purity process, operational in Europe, and the process of the present invention as applied to a 4250 ton $O_2$/day air separation plant delivering a 35 mol percent $O_2$ oxidant flow at 7.22 atm to a blast furnace.

TABLE

| | ADVANCED MEDIUM PURITY PROCESS | INVENTION PROCESS |
|---|---|---|
| A. Process Parameters | | |
| Input Air Flow, $nm^3$/sec | 154.75 | 154.75 |
| Input Air Pressure atm | 3.92 | 3.93 |
| Boost Air Flow, $nm^3$/sec | — | 63.89 |
| Boost air pressure, atm | — | 15.99 |
| Boost Air Temperature, K | — | 455. |
| Upper column pressure, atm | 1.0 | 1.0 |
| Product $O_2$ content, mol percent | 60. | 70. |
| Product Pressure atm. | 1.0 | 7.22 |

TABLE-continued

| | ADVANCED MEDIUM PURITY PROCESS | INVENTION PROCESS |
|---|---|---|
| Product flow, $nm^3$/sec | 52.14 | 44.7 |
| Product flow, tons $O_2$/day | 4250. | 4250. |
| Blend air flow, $nm^3$/sec | 92.78 | 111.3 |
| Blend air pressure, atm | 1.0 | 7.22 |
| Blend air temperature, K | 290 | 540 |
| Oxidant flow, $nm^3$/sec | 144.14 | 156.0 |
| Oxidant $O_2$ content, mol percent | 35 | 35 |
| Oxidant pressure, atm | 7.22 | 7.22 |
| Oxidant temperature, K | 544 | 515 |
| SEC at Prod. Press, kWh/TEPO | 224 | 267 |
| SEC corrected to P = 1 atm, T = 544° K., kWh/TEPO | 224 | 177.5 |
| B. Power Consumption | | |
| Input Air Compressor, KW | 35,180 | 29,630 |
| Boost Air Compressor, KW | 0 | 13,410 |
| Expansion Turbine (Recovery), KW | −620 | −781 |
| Product Pump, KW | 0 | 86 |
| Blend Air Compressor, KW | 0 | 36,135 |
| Oxidant Compressor, KW | 52,990 | 0 |
| TOTAL POWER, KW | 87,550 | 78,480 |

While this invention has been described as having certain preferred embodiments, it will be understood that it is capable of still further variations and modifications, and this application is intended to cover all variations, modifications, and adaptations of the invention which are apparent to one of skill in the art and which fall within the scope of the appended claims.

We claim:

1. A method for the separation of gaseous mixtures, the major components of which are oxygen and nitrogen, for producing medium purity oxygen, comprising:

compressing the gaseous mixture in a first compressor to super atmospheric pressure, and dividing the pressurized gaseous mixture into first and second mixture streams;

cooling said first mixture stream to its boiling point and introducing said first mixture stream into the high pressure chamber of a double rectification column;

compressing and cooling said second mixture stream, condensing the cooled second mixture stream, and delivering the condensed second mixture stream to the high pressure chamber of the double rectification column;

separating the gaseous mixtures in the double rectification column into a liquid oxygen product stream and a gaseous nitrogen stream, removing said liquid oxygen product stream from the low pressure chamber of the double rectification column, pumping said liquid oxygen product stream to a predetermined pressure, evaporating said oxygen product stream in an evaporator-condenser, heating said oxygen product stream, and blending said oxygen product stream with a compressed blend-air stream to the desired oxygen concentration.

2. A method as in claim 1 and including removing gaseous nitrogen from the low pressure chamber, and heating said gaseous nitrogen by means of the heat generated in said first compressor.

3. A method as in claim 2 and including passing the cooled second mixture stream through a molecular sieve for removing impurities therefrom.

4. A method as in claim 3 and including regenerating said molecular sieve by means of said heated gaseous nitrogen.

5. A method as in claim 2 and including compression said second mixture stream in a boost air compressor to a pressure greater than the desired product pressure prior to cooling thereof by the final product stream in the heat exchanger, and recovering the heat of compression of said boost compressor.

6. A method as in claim 5 and including heating said oxygen-enriched stream by means of the heat generated in said boost air compressor.

7. A method as in claim 1 wherein said gaseous mixture comprises air.

8. A method for the separation of gaseous mixtures, specifically air, for producing medium purity oxygen, comprising:

compressing the gaseous mixture in a first compressor to about 3.9–4.1 atmospheres pressure, passing said compressed gaseous mixture in heat exchange relationship with sub-ambient temperature gaseous nitrogen, and dividing the cooled, pressurized gaseous mixture into first and second mixture streams;

cooling the first mixture stream to its boiling point and introducing the cooled first mixture stream into the high pressure chamber of a double rectification column;

compressing, cooling, condensing, and delivering the second mixture stream to the high pressure chamber of the double rectification column;

separating the gaseous mixtures in the double rectification column into a liquid oxygen-enriched stream and a gaseous nitrogen stream, removing the gaseous nitrogen stream from the double rectification column for cooling said compressed gaseous mixture, removing the liquid oxygen-enriched stream from the low pressure chamber of the double rectification column, pumping the liquid oxygen-enriched product stream to a predetermined pressure, evaporating the oxygen-enriched product stream in an evaporator-condenser, heating the oxygen-enriched product stream, and blending the oxygen-enriched product stream with a compressed blend-air stream to the desired oxygen concentration.

9. A method for the separation of gaseous mixtures for producing medium purity higher boiling point component, comprising:

compressing the gaseous mixture in a first compressor to super atmospheric pressure, and dividing the pressurized gaseous mixture into first and second mixture streams;

cooling the first mixture stream to its boiling point and introducing the first mixture stream into the high pressure chamber of a double rectification column;

compressing, cooling, and condensing the second mixture stream, and delivering the condensed second mixture stream to the high pressure chamber of the double rectification column;

separating the gaseous mixtures in the double rectification column into a liquid higher boiling point component product stream and a gaseous lower boiling point component stream, removing said liquid higher boiling point component product stream from the low pressure chamber of the double rectification column, pumping said liquid higher boiling component product stream to a predetermined pressure, evaporating said pressurized liquid higher boiling point component product stream in an evaporator-condenser, heating said evaporated higher boiling point component product stream, and blending said heated higher boiling point component product stream with a compressed blend mixture stream to the desired higher boiling point component concentration.

* * * * *